United States Patent [19]

Lis

[11] 4,350,085

[45] Sep. 21, 1982

[54] AIR CONDITIONING APPARATUS FOR FARMING AND ANIMAL HUSBANDRY ACTIVITIES INDUSTRIAL FACILITIES AND WELL-BEING IN GENERAL

[76] Inventor: Ricardo B. Lis, Riera, 8 - San Cugat del Valles, Province of Barcelona, Spain

[21] Appl. No.: 217,997

[22] Filed: Dec. 18, 1980

[30] Foreign Application Priority Data

Jan. 8, 1980 [ES] Spain ..... 487.513

[51] Int. Cl.[3] ..... G03F 7/02

[52] U.S. Cl. ..... 98/33 A; 62/325; 62/427

[58] Field of Search ..... 98/33 R, 33 A; 62/412, 62/427, 325, 410, 411

[56] References Cited

U.S. PATENT DOCUMENTS

| | | | |
|---|---|---|---|
| 1,965,078 | 7/1934 | Hewitt et al. | 98/33 A |
| 2,091,562 | 8/1937 | Palmer | 98/33 A |
| 3,018,642 | 1/1962 | Lathrop | 62/427 |
| 3,583,175 | 6/1971 | Eubank | 98/33 |
| 3,722,395 | 3/1973 | Courchesne | 98/33 A |
| 3,911,953 | 10/1975 | Crombie | 62/325 |
| 3,995,446 | 12/1976 | Eubank | 62/325 |
| 4,048,811 | 9/1977 | Ito et al. | 98/33 R |

*Primary Examiner*—Lloyd L. King

*Attorney, Agent, or Firm*—Michael J. Striker

[57] ABSTRACT

An air conditioning apparatus for use in industrial facilities includes a housing subdivided into three compartments by two partitions spaced from one another along the height of the housing. The top compartment is formed with an opening on its side wall and provided with a fan positioned on the top of the housing. The foul air admitted into said opening is extracted into atmosphere by the fan. A number of fans are also positioned on the middle partition and a number of respective openings covered with gratings are provided on the walls of the middle and the bottom compartments. All the fans are electrically controlled from outside of the housing to draw air through the apparatus for refreshing air in the room, for filtering, heating or humidifying air in the room when desired.

12 Claims, 5 Drawing Figures

AIR CONDITIONING APPARATUS FOR FARMING AND ANIMAL HUSBANDRY ACTIVITIES INDUSTRIAL FACILITIES AND WELL-BEING IN GENERAL

BACKGROUND OF THE INVENTION

The present invention refers to an air conditioning apparatus intended for farming and animal husbandry activities, industrial facilities.

SUMMARY OF THE INVENTION

It is an object of the invention to provide an effective control of the temperature (in both heating and cooling), and in addition of humidity, foul air and harmful or dangerous gases. Another object of the invention is that it has units capable of either fully automatic or manual operation. Still another object of the invention is that it can be equipped with a system for dispensing products intended to increase the state of conditioning or healthfulness of the premises in which the apparatus is installed. Further advantages of the invention reside in so that it can be adapted to whatever requirements of delivery or peculiar to each type of installation, its parts, materials, capacity, dimensions, configuration and so on are broadly variable according to the needs of each case; it can be installed indoors, outdoors, between rooms or in the centre of rooms; the power supply can be the most appropriate for each case, whether because of ease of installation of the system or because of abundant availability of sources in the area where the apparatus is installed; the air intakes, whether indoor or outdoor, can be located at the appropriate places for maximum performance, and the same is true of the openings for outlet or exhaust of the said air; and the apparatus of the invention can be fitted with ducts for both intake and exhaust of the air, allowing the intake and exhaust points to be remotely located.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 5:
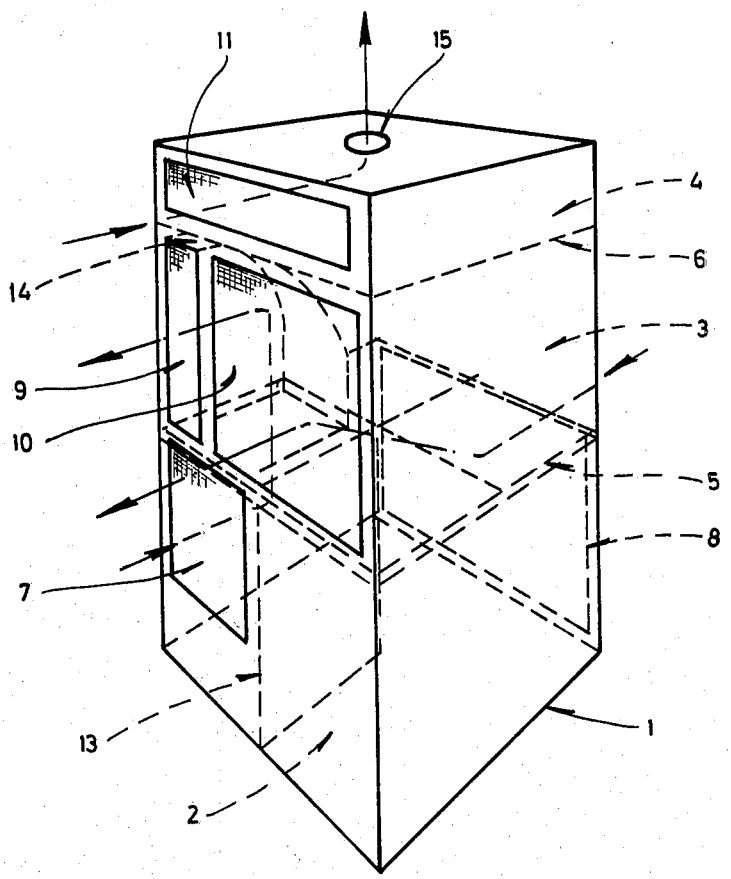
FIG. 5 is a perspective view showing the direction of flow of the air currents originating in the said apparatus.

The air conditioner consists of a housing (1) of varying material, shape and dimensions, usually a parallelepiped of sheet metal, which is internally subdivided into three superimposed compartments (2), (3) and (4) separated by upper and lower partitions (5) and (6) (as seen in FIG. 5).

At the position of compartment (2), two opposite walls of the housing (1) have front and rear openings (7) and (8), each fitted with a protective grating. corresponding to compartment (3) are two front openings (9) and (10), also equipped with gratings. Lastly, the upper compartment (4) has an opening (11), likewise with a grating.

Figure 1:
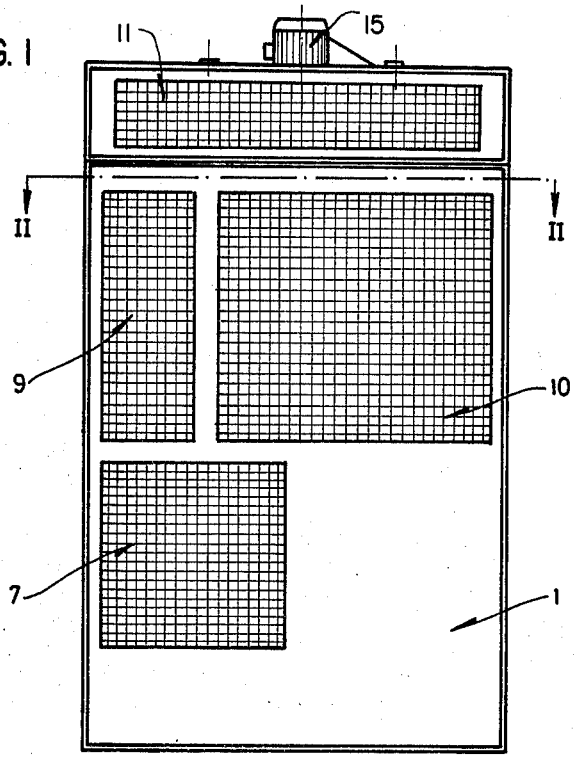
FIG. 1 is a front elevation of the apparatus according to the invention
Figure 2:
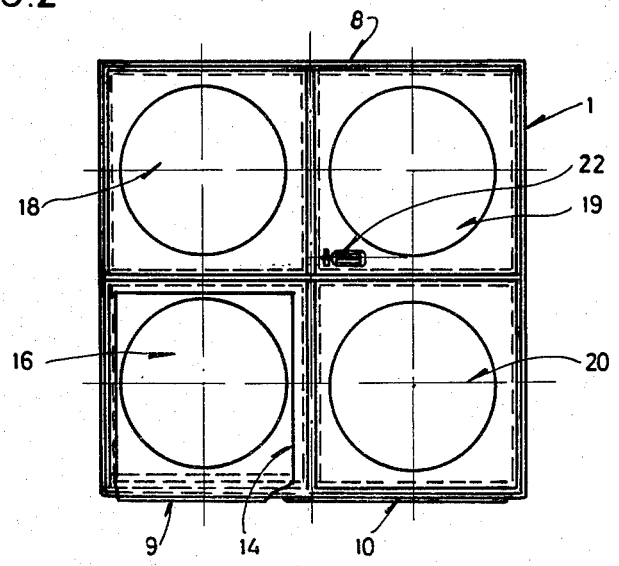
FIG. 2 is a plan view in section at line II—II of FIG. 1.
Figure 3:
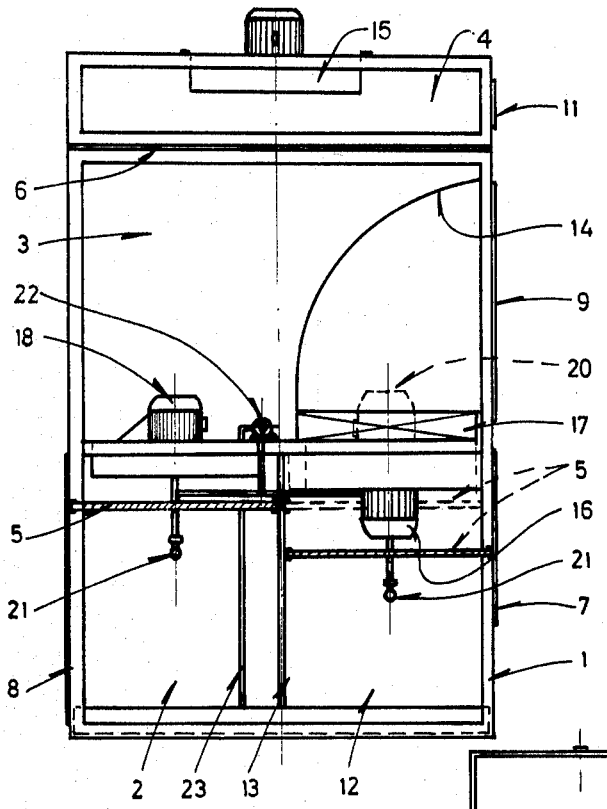
FIG. 3 shows the conditioner in elevation with one of its sides removed to allow the interior to be seen.
Figure 4:
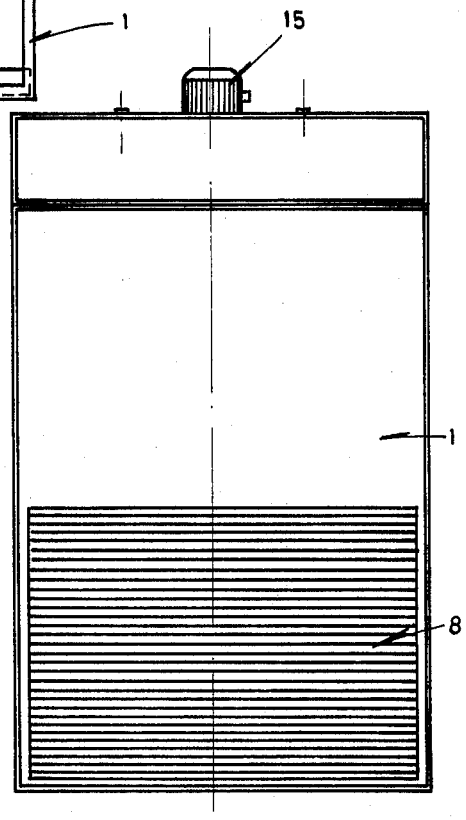
FIG. 4 is an elevation, of the rear side of the apparatus in relation to FIG. 1.

As seen in FIG. 3 at the bottom or base of the lower compartment (2) is a pan (12) holding water or some other liquid, which is brought into it by an ordinary pipe (not shown). Compartment (2) itself is divided in two by a central partition (13), while the middle opening (9) communicates only with an inner enclosure consisting of a shell-shaped deflector (14). In consequence of the aforesaid partitions and dividers, the air flows cannot become mixed, in that air coming in through the opening (11) does not descend into the middle compartment (3), air entering through the opening (7) is forced to go out through (9) and air coming in through (8) must of necessity leave through the opening (10), as shown in FIG. 5.

On the top of the unit is a suction fan or air extractor which will expel to the outside the air drawn by suction into compartment (4) through opening (11).

On the middle partition (5) have in this case been mounted four fans, one of them (16) being provided with a heating device (17) based on electrical resistors or the equivalent and located at the beginning of the deflector shell (14), whose function is to draw in air through the opening (7) and blow it out hot through the opening (9). The remaining three fans (18), (19) and (20) are fitted in the other spaces of the middle partition (5), and are all (16), (18), (19) and (20) equipped with atomizers (21) (FIG. 3), which are supplied with liquid from the pan (12) by a pump (22) equipped with a corresponding riser pipe (23).

On any side of the housing (1) or in a remote location is an electrical control panel, possibly combined with a programmer, for starting and stopping the fans as desired and for actuating the heater battery and the atomizers.

From examination of the attached drawings, it will be apparent that the capabilities or functions of this conditioning apparatus are the following:

(a) Extraction of foul or toxic air from the room in which the said apparatus is installed.

Only the top extractor (15) runs, acting to draw in the air through the opening (11) and expel it through the extractor (15) (FIG. 5). A discharge duct leading outside can also be fitted at this point.

(b) Closed circuit circulation and filtration of room air:

Only fan (16) which may be provided with a conventional filter; runs, drawing in air through the opening (7) and up the shell (14) and expelling it through the opening (9). If it is desirable for this warm air to be humid, the corresponding atomizer (21) is run at the same time, and if it is wished that this air should be hot (dry and hot or moist and hot), the heater (17) would have to be turned on to produce these effects.

(c) Renewal of air with intake outside the room:

In this case, the intake (8) would be located outside the enclosed atmosphere, to allow fans (18), (19) and (20) to produce a strong suction through the opening (8) and exhaust a large flow of air through the opening (10); This large flow of air, can be humid or dry depending on whether or not the respective atomizers (21) are run.

(d) Heating and cooling:

The heating is effected by the board of electrical resistors (17) or any appropriate heating unit, over which runs the air delivered by fan (16). This air can be hot and dry or hot and moist according to the requirements of the room. As is known, it is advisable in certain industries and facilities (for example, greenhouses) to maintain a given level of temperature and humidity. For cooling, outside air can be used, which can also be humidified in the way described.

(e) It is apparent that if the liquid contained in the pan (12) is a disinfectant or deodorant, the atmosphere can be improved in this respect as well as that of the aforesaid conditions.

This apparatus is sufficiently powerful to allow both intake and exhaust to take place through fairly long ducts. In this case, the respective ducts are fitted to intake openings (11), (8) and (7) and outlet openings (15), (9) and (10). While the deflector wall (14) is here seen fitted in combination with the suction-injection unit for closed circuit circulation of air, it can also be used with the remaining units of the apparatus.

This apparatus is extremely useful, in that in a single unit it makes possible various combinations which until now were not feasible without using complicated and hard to control elements. In addition, it represents a high-performance industrial design. Its components are simply built and very easy to maintain, and its working parts are operated from a control board requiring no special skill.

Immaterial to the object of the invention will be the materials, shapes and dimensions of the elements making up the described apparatus, the humidifying and heating systems used in it, the type and number of fans used to circulate the air, the characteristics of the pump or pumps used to atomize the water or liquid, the location and number of the openings through which the air passes, the fitting of ducts of the necessary length to take in air and deliver it to the required point, details of assembly of the apparatus for installation inside, outside and in central areas of the respective rooms, and the purpose of the flows of cool and dry, cool and moist, hot and dry and hot and moist air for conditioning in industry, farming and animal husbandry, or general wellbeing, provided that the variations introduced do not affect its essential nature.

It will be understood that each of the elements described above, or two or more together, may also find a useful application in other types of air-conditioning apparatus differing from the types described above.

While the invention has been illustrated and described as embodied in an air-conditioning apparatus, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An air conditioning apparatus for use in industrial facilities such as farming, animal husbandry, or the like, comprising a housing bounded by external walls and having a top, said housing being subdivided into a bottom compartment, a middle compartment and a top compartment by partitions spaced from one another along the height of said housing, each of said compartments including at least one opening formed on the respective external wall; and a number of fans located in said housing and provided with humidifying means, a least one of said fans being provided with a heating unit; electrical means mounted outside of said housing and operatively connected to said fans, said fans being electrically controlled by said electrical means so as to create a first air flow which is drawn in and expelled from the apparatus through said top compartment for extracting of foul and toxic air from an enclosed room in which the apparatus may be positioned, a second air flow which enters said housing thrugh one of said openings, circulates within said housing in closed circuit and leaves said housing in warmed or condition, and a third air flow which enters said housing from atmosphere through one of said openings and leaves said housing through another of said openings for renewal air in the enclosed room.

2. The apparatus of claim 1, wherein said housing has a shape of a parallel-piped.

3. The apparatus of claim 2, further including a number of gratings, each of said openings being covered with a respective grating.

4. The apparatus of claim 3, wherein said housing has a front wall, one of said openings being formed on said front wall in the region of said top compartment to admit air into said top compartment, said top being communicated with the atmosphere, one of said fans being mounted on said top to create said first air flow and to extract the foul or harmful air from the enclosed room to the atmosphere.

5. The apparatus of claim 4, wherein one of said partitions is a middle partition, all the remaining fans being mounted on said middle partition.

6. The apparatus of claim 5, wherein two of said openings are formed on said front wall in the region of said middle compartment and one opening is formed on said front wall in the region of said bottom compartment to admit air into said bottom compartment and wherein a shell-shaped deflector is provided in said middle compartment in communication with one of the openings of said middle compartment, said opening of said bottom compartment being in communication with said one of the openings of said middle compartment, said fan provided with a heating unit being arranged in said middle compartment to create said second air flow so that air admitted into said bottom compartment circulates in closed circuit in said middle compartment and leaves the housing through said one opening of said middle compartment in warmed moist condition when desired.

7. The apparatus of claim 6, wherein said fan provided with a heating unit is equipped with a filter to filtrate air leaving said housing.

8. The apparatus of claim 7, wherein said housing has a rear wall and wherein another opening is formed in said bottom compartment on said rear wall, said another opening being communicated with the atmosphere to admit fresh air into said bottom compartment, said remaining fans being adapted to draw said fresh air through said middle compartment to create said third air flow so that fresh air leaves said housing through another one of said two openings of said middle compartment.

9. The apparatus of claim 8, wherein said humidifying means are atomizers connected to said remaining fans.

10. The apparatus of claim 9, further including a pan located in said bottom compartment and filled with a liquid.

11. The apparatus of claim 10, further including a number of pumps interconnected between said pan and said atomizers.

12. The apparatus of claim 11, further including connecting ducts and fittings for connecting said openings to the respective intake and outlet points for air.

* * * * *